US009856724B2

(12) United States Patent
White et al.

(10) Patent No.: US 9,856,724 B2
(45) Date of Patent: Jan. 2, 2018

(54) APPARATUS FOR HYDROCARBON RESOURCE RECOVERY INCLUDING A DOUBLE-WALL STRUCTURE AND RELATED METHODS

(71) Applicant: HARRIS CORPORATION, Melbourne, FL (US)

(72) Inventors: John E. White, Melbourne, FL (US); Murray T. Hann, Malabar, FL (US); Brian N. Wright, Indialantic, FL (US); Mark A. Trautman, Melbourne, FL (US); Raymond C. Hewit, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 536 days.

(21) Appl. No.: 14/561,657

(22) Filed: Dec. 5, 2014

(65) Prior Publication Data

US 2016/0160623 A1 Jun. 9, 2016

(51) Int. Cl.
*E21B 43/24* (2006.01)

(52) U.S. Cl.
CPC ..... *E21B 43/2401* (2013.01); *E21B 43/2406* (2013.01); *E21B 43/2408* (2013.01)

(58) Field of Classification Search
CPC .... E21B 43/24; E21B 43/166; E21B 43/2401; E21B 36/00; E21B 36/04; E21B 34/12
See application file for complete search history.

(56) References Cited

U.S. PATENT DOCUMENTS

| | | | | |
|---|---|---|---|---|
| 7,441,597 | B2 | 10/2008 | Kasevich | |
| 7,770,602 | B2 | 8/2010 | Buschhoff | |
| 7,891,421 | B2 * | 2/2011 | Kasevich | E21B 43/003 166/177.1 |
| 9,328,593 | B2 | 5/2016 | Wright | |
| 2005/0103497 | A1 | 5/2005 | Gondouin | |

(Continued)

FOREIGN PATENT DOCUMENTS

CA 2304938 A1 * 2/2001 ..... C09K 8/592

OTHER PUBLICATIONS

Wright et al., U.S. Appl. No. 14/491,530, filed Sep. 19, 2014.
Wright et al., U.S. Appl. No. 14/491,563, filed Sep. 19, 2014.
Wright et al., U.S. Appl. No. 14/491,545, filed Sep. 19, 2014.

*Primary Examiner* — Robert E Fuller
*Assistant Examiner* — David Carroll
(74) *Attorney, Agent, or Firm* — Allen, Dyer, Doppelt + Gilchrist, P.A.

(57) ABSTRACT

A device for hydrocarbon resource recovery from at least one well in a subterranean formation may include a radio frequency (RF) source, a solvent source, and a double-wall structure coupled to the RF source to define an RF antenna within the at least one well to provide RF heating to the subterranean formation. The double-wall structure may absorb heat from adjacent portions of the subterranean formation. The double-wall structure may also include inner and outer walls defining a solvent passageway therebetween coupled to the solvent source. The outer wall may have a plurality of openings therein to eject solvent into the subterranean formation. The double-wall structure may transfer heat to the solvent so that the ejected solvent is in a vapor state.

27 Claims, 5 Drawing Sheets

(56) References Cited

U.S. PATENT DOCUMENTS

| | | | | |
|---|---|---|---|---|
| 2008/0083534 | A1* | 4/2008 | Daussin | C09K 8/592 166/272.4 |
| 2009/0071652 | A1* | 3/2009 | Vinegar | E21B 36/04 166/303 |
| 2010/0065265 | A1* | 3/2010 | Kasevich | E21B 43/003 166/248 |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2012/0061080 | A1 | 3/2012 | Sultenfuss et al. | |
| 2012/0067580 | A1* | 3/2012 | Parsche | E21B 43/2401 166/302 |
| 2013/0199774 | A1 | 8/2013 | Sultenfuss et al. | |
| 2014/0020908 | A1* | 1/2014 | Wright | E21B 43/2401 166/378 |
| 2014/0041890 | A1 | 2/2014 | Wright et al. | |
| 2014/0216726 | A1* | 8/2014 | Dittmer | E21B 43/2401 166/248 |
| 2015/0068706 | A1* | 3/2015 | Hann | E21B 43/2408 165/45 |

* cited by examiner

APPARATUS FOR HYDROCARBON RESOURCE RECOVERY INCLUDING A DOUBLE-WALL STRUCTURE AND RELATED METHODS

FIELD OF THE INVENTION

The present invention relates to the field of radio frequency (RF) equipment, and, more particularly, to an apparatus for processing hydrocarbon resources using RF heating and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al, discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale.

Increased power applied within the subterranean formation may result in antenna component heating. One factor that may contribute to the increased heating may be the length of the coaxial transmission line, for example. Component heating for the antenna may be undesirable, and may result in less efficient hydrocarbon resource recovery, for example.

A typical coaxial feed geometry may not allow for adequate flow of a cooling fluid based upon a relatively large difference in hydraulic volume between inner and outer conductors of the coaxial feed. More particularly, a typical coaxial feed may be assembled by bolted flanges with compressed face seals, for example. The coaxial feed also includes a small inner conductor with a standoff for the signal voltage. However, the typical coaxial feed may not be developed for use with a coolant and for increased thermal performance. Moreover, hydraulic volumes of the inner and outer conductors may be significantly different, which may affect overall thermal performance.

To more efficiently recover hydrocarbon resources, it may be desirable to inject a solvent, for example, in the subterranean formation. For example, the solvent may increase the effects of the RF antenna on the hydrocarbon resources. One approach for injecting a solvent within the subterranean formation includes the use of sidetrack wells that are typically used and are separate from the tubular conductors used for hydrocarbon resource recovery.

SUMMARY OF THE INVENTION

An apparatus for hydrocarbon resource recovery from at least one well in a subterranean formation may include a radio frequency (RF) source, a solvent source, and a double-wall structure coupled to the RF source to define an RF antenna within the at least one well to provide RF heating to the subterranean formation. The double-wall structure may absorb heat from adjacent portions of the subterranean formation. The double-wall structure may also include inner and outer walls defining a solvent passageway therebetween coupled to the solvent source. The outer wall may have a plurality of openings therein to eject solvent into the subterranean formation. The double-wall structure may transfer heat to the solvent so that the ejected solvent is in a vapor state. Accordingly, increased heat is transferred which may result in increased hydrocarbon resource recovery.

The apparatus may also include a coolant source and an RF transmission line extending within the double-wall structure and coupling the RF source to the double-wall structure. The RF transmission line may be coupled to the coolant source so that the coolant absorbs heat from the RE transmission line and transfers the heat to the solvent via the inner wall of the double-wall structure, for example. Accordingly, waste heat that would otherwise need to be dissipated at a surface coolant heat exchanger can instead be used down the wellbore to heat the solvent.

The apparatus may further include a choke coupled to the transmission line. The choke may generate heat transferred to the solvent.

The double-wall structure may include a plurality of double-wall sections coupled together in end-to-end relation, for example. The apparatus may further include a coupler joining together respective ends of adjacent double-wall sections. The apparatus may further include at least one jumper line coupling adjacent double-wall sections. The apparatus may also include a clamp surrounding the coupler, for example.

The at least one wellbore may include a horizontally extending injection wellbore and a horizontally extending production wellbore therebelow, for example. The double-wall structure may be positioned within the horizontally extending injection wellbore. The apparatus may further include a producer structure to be positioned within the horizontally extending production wellbore, for example, to produce the hydrocarbon resources. The solvent source may include a source of at least one of butane and propane, for example.

A method aspect is directed to a method for hydrocarbon resource recovery from at least one well in a subterranean formation. The method may include supplying radio frequency (RF) power to a double-wall structure within the at least one well to define an RF antenna to provide RF heating to the subterranean formation. The double-wall structure may absorb heat from adjacent portions of the subterranean formation. The method may also include supplying solvent to a solvent passageway defined between inner and outer walls of the double-wall structure. The outer wall may have a plurality of openings therein to eject solvent into the subterranean formation, the double-wall structure transferring heat to the solvent so that the ejected solvent is in a vapor state.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
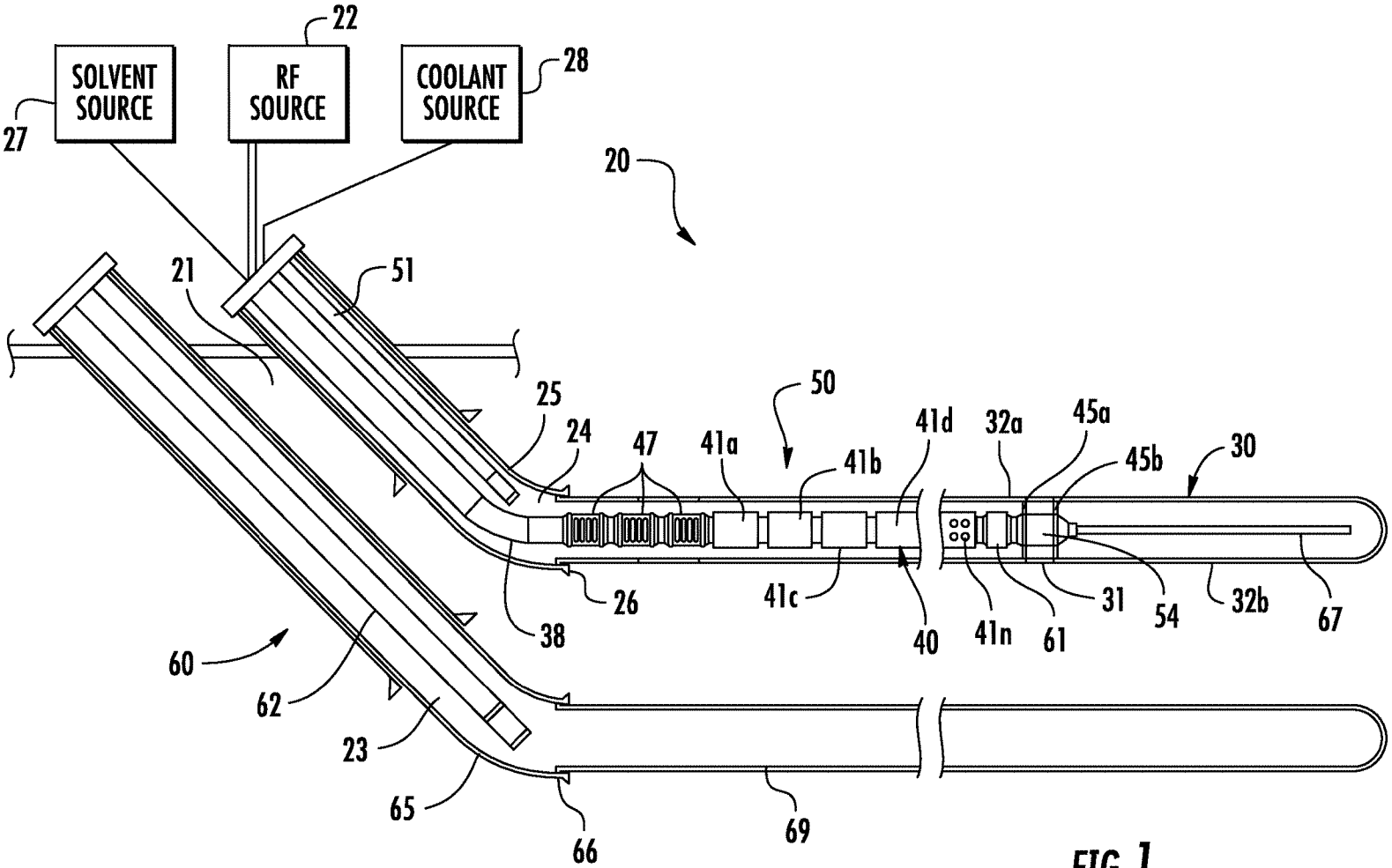
FIG. 1 is a schematic diagram of a subterranean formation including an apparatus according to an embodiment of the present invention.

Referring initially to FIG. 1, an apparatus 20 for hydrocarbon resource recovery in a subterranean formation 21 is described. The subterranean formation 21 includes an upper wellbore 24 therein. The upper wellbore 24 illustratively extends horizontally within the subterranean formation 21 and may be an injection wellbore, for example. In some embodiments, the apparatus 20 may be used with a vertically extending wellbore, for example, in a subterranean formation 21.

The subterranean formation 21 may includes a lower wellbore 23 below the upper wellbore 24, such as would be found in a SAGD implementation, for production of petroleum, etc., released from the subterranean formation 21. The upper wellbore 23 illustratively extends horizontally within the subterranean formation 21 and may be referred to as a production wellbore.

The apparatus 20 also includes a radio frequency (RF) source 22 at the ground surface. The apparatus 20 also includes a solvent source 27 and a coolant source 28. The solvent source 27 may be a source of one or more of butane and propane, for example. The solvent source 27 may also be a source for other and/or additional solvents, as will be appreciated by those skilled in the art, for example, to increase hydrocarbon resource processing efficiency. The coolant source 28 may be a source of a dielectric cooling liquid as explained in greater detail below and as will be appreciated by those skilled in the art.

The apparatus 20 further includes a double-wall structure 40 coupled to RF source 22 to define an RF antenna within the wellbore 24 to provide RF heating to the subterranean formation 21. More particularly, the double-wall structure 40 is part of a tool 50 coupled to a tubular RF antenna to heat the subterranean formation, as will be described in further detail below. The double-wall structure 40 is positioned within the horizontally extending injection wellbore 24. The double-wall structure 40 absorbs heat from adjacent portions of the subterranean formation 21. For example, radiant heat from the liner or tubular RF antenna 30 may be about 225° C., while the interior heat for cooling liquid is about 80° C.

The double-wall structure 40 includes a plurality of double-wall sections 41*a*-41*n* coupled in end-to-end relation. For example, the double-wall sections 41*a*-41*n* may account for nearly 45% of the overall antenna length, or about twenty-six, 9-meter sections.

The tubular RF antenna 30 may be slidably positioned through an intermediate casing 25, for example, in the subterranean formation 21 extending from the surface. The tubular RE antenna 30 may couple to the intermediate casing 25 via a thermal liner packer 26 or debris seal packer (DSP), for example.

The tubular RF antenna 30 includes first and second sections 32*a*, 32*b* and an insulator 31 or dielectric therebetween. As will be appreciated by those skilled in the art, the tubular RF antenna 30 defines a dipole antenna. In other words, the first and second sections 32*a*, 32*b* each define a leg of the dipole antenna. Of course, other types of antennas may be defined by different or other arrangements of the RF antenna 30. In some embodiments (not shown), the tubular RF antenna 30 may also have a second insulator therein. A suction line 51 is illustratively included in the horizontally extending injection wellbore 24.

A producer structure 60 may be positioned within the lower horizontally extending production wellbore 23. In particular, the producer structure 60 may include a tubular well pipe 69, which may couple to a respective intermediate casing 65 via a thermal liner packer 66 or DSP, for example. A suction line 62 may also be positioned in the horizontally extending injection wellbore 23.

Choke sections 47, for example, are coupled to the RF transmission line 38 as part of the tool 50. The choke sections 47 advantageously generate the heat that is also transferred to the solvent. Any number of chokes may be used. An anchoring device 61, which is part of the tool 50, is coupled to a distal end of the double-wall structure 40 for securing the tool 50, for example, within the first antenna section 32*a*.

RF contacts 45*a*, 45*b* spaced apart by a dielectric spacer 54 couple the tubular RF antenna 30 to the RF transmission line 38. The RF transmission line 38 may be a coaxial RF transmission line, and the RF contacts 45*a*, 45*b* may couple the outer and inner conductors to the respective first and second antenna sections 32*a*, 32*b* of the tubular RF antenna 30. The tool 50 also includes a guide member 67, for example in the form of a guide string, coupled adjacent the RF contacts 45*a*, 45*b* at a distal end of the horizontally extending injection wellbore 24. Further details of an exemplary choke 47, an anchoring device 61, the RF contact arrangement, and guide member 67 can be found in U.S. patent application Ser. Nos. 14/076,501, 14/491,530, 14/491,563, and 14/491,545, for example, all of which are assigned to the assignee of the present application, and all of which are herein incorporated in their entirety by reference.

Figure 2:
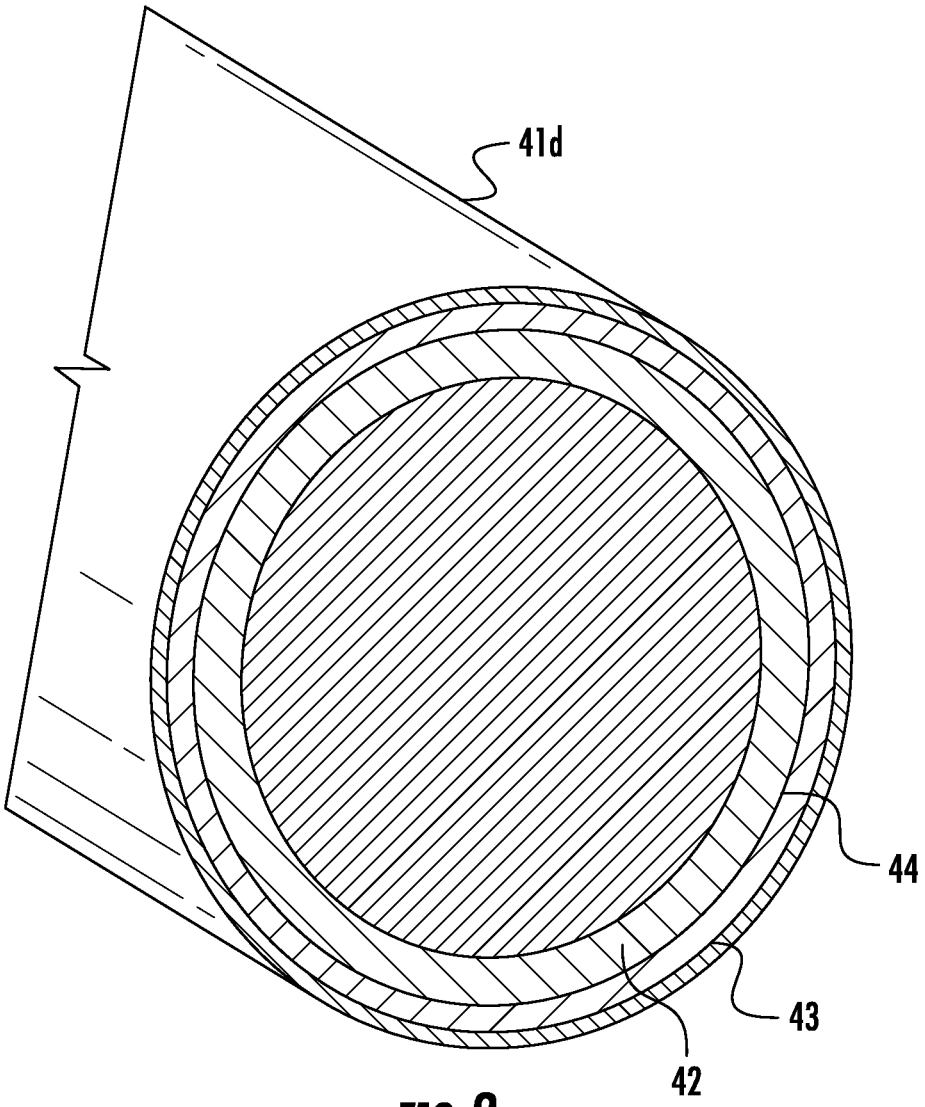
FIG. 2 is a perspective view of a portion of a double-wall structure according to an embodiment of the present invention.
Figure 3:
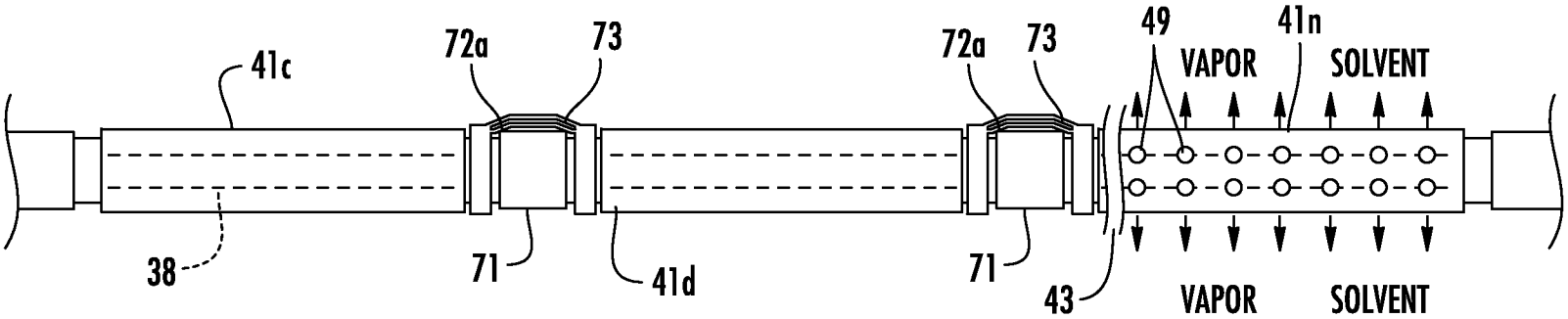
FIG. 3 is a schematic diagram of a series of double-wall segments of a double-wall structure according to an embodiment of the present invention.

Referring now additionally to FIGS. 2 and 3, each double wall section 41*a*-41*n* includes inner and outer walls 42, 43 defining a solvent passageway 44 therebetween. The inner and outer walls 42, 43 may each be a tubular liner, as will be appreciated by those skilled in the art. The solvent passageway 44 is coupled to the solvent source 27. The outer wall 43 of the last or distal wall section 41*n* has openings 49 (FIG. 2) therein to eject solvent into the subterranean formation 21. Of course, other and/or additional double-wall sections 41*a*-41*d* may include openings.

The openings 49 may be FacsRite screen ports, part of a slotted liner, wire mesh wrapped pipe, or any other sand control device. As will be appreciated by those skilled in the art, the double-wall structure 40, transfers heat to the solvent so that the ejected solvent is in a vapor state.

The RF transmission line 38 extends within the double-wall structure 40 and couples the RF source 22 to the double-wall structure. The RF transmission line 38 is also coupled to the coolant source 28 so that the coolant absorbs heat from the RF transmission line and transfers the heat to the solvent via the inner wall 42 of the double-wall structure 40.

Figure 4:
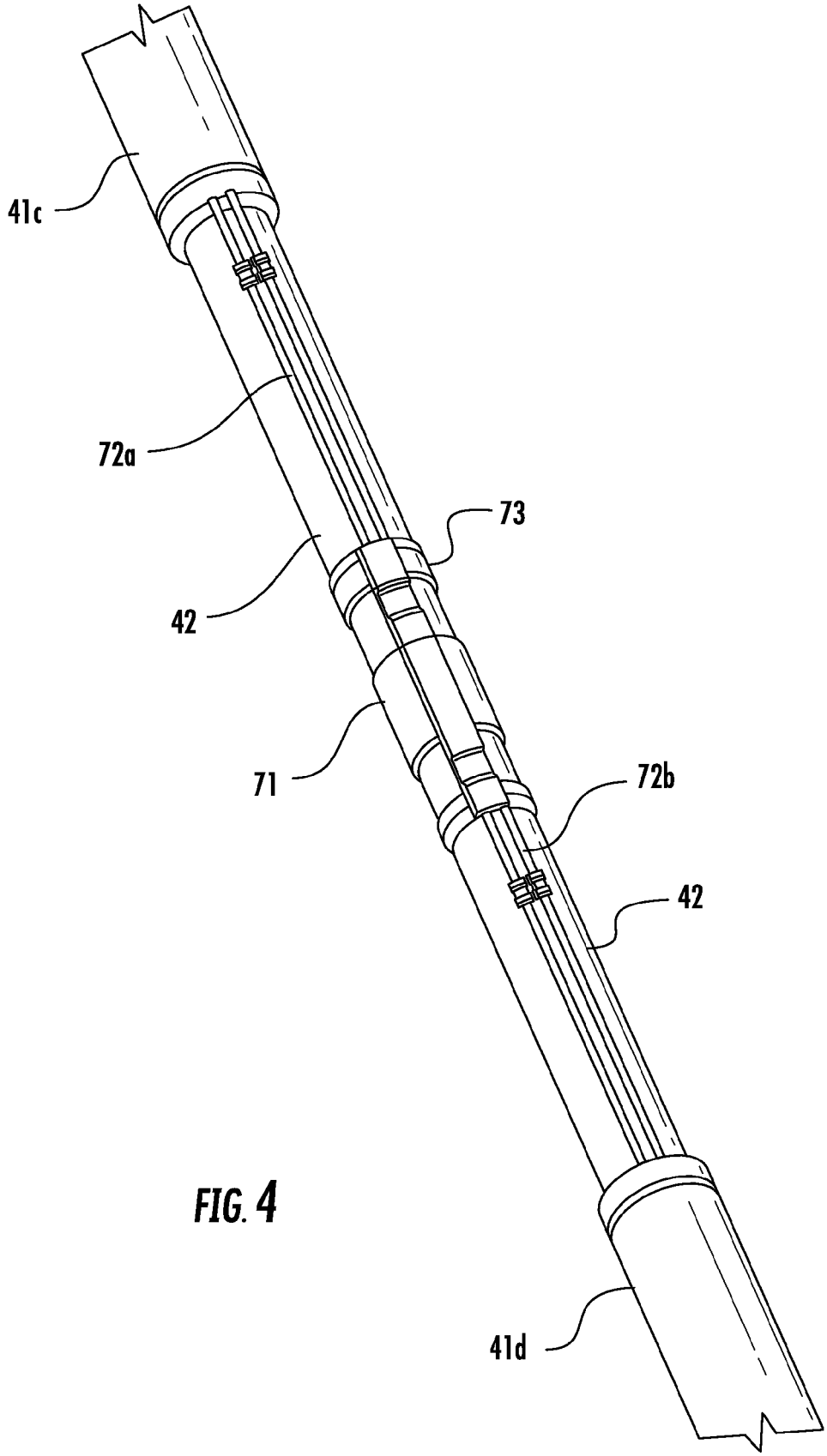
FIG. 4 is a perspective view of a portion of two adjacent double-wall segments and a respective coupler according to an embodiment of the present invention.
Figure 5:
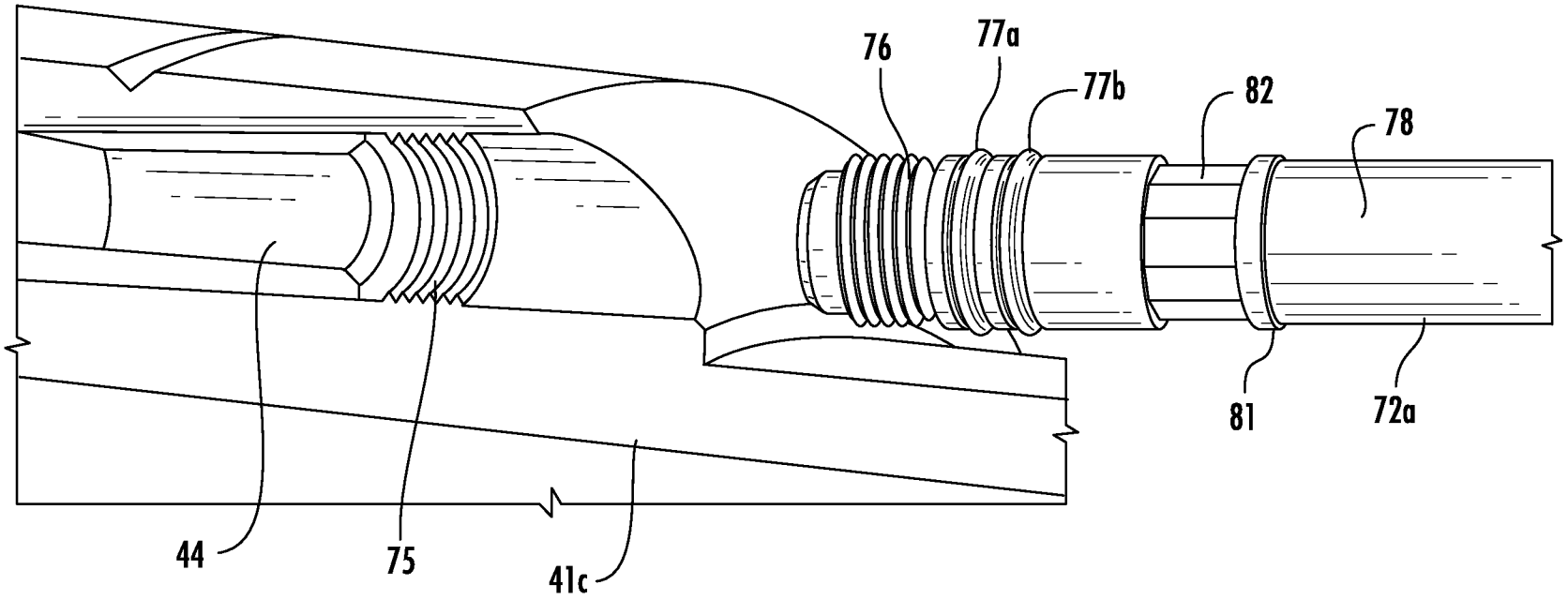
FIG. 5 is an enlarged partial-cross-sectional view of a double-wall segment and a jumper line according to an embodiment of the present invention.

Referring now additionally to FIGS. 4-5, a coupler 71 joins together respective ends of adjacent double-wall sections 41*a*-41*n*. Jumper lines 72*a*, 72*b*, for example two, couple adjacent double-wall sections 41*a*-41*n*. Of course, any number of jumper lines 72 may couple the respective solvent passageways of adjacent double-wall sections 41*a*-41*n*. The jumper lines 72*a*, 72*b* may carry solvent between adjacent double-wall sections 41*a*-41*n* at the respective coupler 71, for example. A respective clamp 73 surrounds at least a portion of each coupler 71. The clamp 73 may be a protective clamp, for example, a protective steel clamp. In some embodiments, jumper lines may not be used, but instead a double-wall fitting may be used. The double wall fitting may allow both the connection and isolation of adjacent double-wall sections 41*a*-41*n*.

The solvent passageway 44 of each double-wall section 41*a*-41*n* may include threads 75 at ends thereof for receiving a threaded end 76 of the jumper lines 72*a*, 72*b* and to define a metal-to-face face seal. Each end of each jumper line 72*a*, 72*b* may include a pair of seals 77*a*, 77*b*, for example, O-rings, adjacent the threaded end 76 of the jumper line 72*a*, 72*b*. Each jumper line 72*a*, 72*b* may also include a tubular body 78 that defines part of the solvent passageway 44. The tubular body 78 is welded, for example, at a tubular joint 81 adjacent a torque area 82. The torque area 82 may a 12-point torque area, for example, for securing the jumper line 72*a*, 72*b*. In some embodiments, the coupling of each of the jumper lines 72*a*, 72*b* may include a beam seal, for example, available as a commercial off the shelf (COTS) part. An advantage of the beam seal may be that no or fewer O-rings may be used. Additionally, there may be higher temperature and pressure capability at a lower cost, for example, as compared to O-rings.

As will be appreciated by those skilled in the art, solvent vaporization may typically be done at the surface, and the vaporized solvent pumped down hole via vacuum insulated tubing or two concentric strings with a blanket gas between them. This may either be done with a cold process (sometimes with a heater down hole) or in combination with SAGD. These systems generally do not have major heat loss problems in the supply line (e.g., relatively small temperature differences) and tube diameters are not compatible with RF system diametral envelope and deployment constraints.

Delivering solvent as a vapor from above the surface is extremely difficult to accomplish because of thermal losses as the solvent is pumped down hole. Accordingly, it may be relatively common to see resistive heaters added within a wellbore to, along with surface super heaters, keep the solvent in a vapor phase. Surface super-heaters, down hole resistive heaters, multiple concentric strings, and vacuum insulated tubing are relatively expensive and occupy critical wellbore space.

To more efficiently recover hydrocarbon resources from the subterranean formation, it may be desirable to inject solvent (e.g., butane in more shallow wellbores, propane in deeper wellbores). These solvents, however, are each a phase change liquid. Increased efficiency generally results when the solvent enters the subterranean formation, for example, adjacent the hydrocarbon resources in a gaseous state. Solvents that enter the subterranean formation as a liquid may cause decreased performance or efficiency, and may permanently degrade the well, as will be appreciated by those skilled in the art.

Moreover, heat loss to the overburden region of the subterranean formation condenses the solvent. Insulation of the liner is generally not practical, and thus, it may be advantageous to vaporize the solvent downhole or within the wellbore.

Commercial length RF recovery systems generally require 4.2 to 8.4 tonne/day/100 m of solvent, and vaporizing 1 tonne/day of solvent typically requires on the order of 4.5 kW. Of course, these numbers may vary based upon environmental conditions. A 600 m exemplar may require 250 kW of heat energy for solvent vaporization. If electric power used, this may correspond to about 750 kW of fuel energy.

As will be appreciated by those skilled in the art, the double-wall structure 40 described herein vaporizes solvent, for example, within diametral envelopes. With surface vaporization or downhole resistive heating, electric power required is about 250 kW for a given example.

Using the double-wall structure 40, the 250 kW comes from two sources: convection and radiation from the liner or RF antenna 30 to the outer wall 43, and convection from the cooling oil to the inner wall 42. The convection and radiation from the liner to the outer wall 43 take energy out of the near-antenna pay zone that was heated by RF. As the near-antenna zone is at a higher than desired temperature, this energy comes with little or no impact. For the given example, 240 kW comes from the above-noted convection and radiation. It should be noted that the RF heat supplied to the pay zone for this low power high flow case is 600 kW.

With respect to convection from the cooling oil or dielectric fluid to the inner wall 42, the supply temperature is increased by decreasing the cooling of the return cooling oil. When the return temperature is equal to the supply temperature, no oil heating or cooling is desired. Effectively this process transfers an increased amount of the heat that is added to the cooling oil and transfers it to the solvent.

Effectively, the solvent is vaporized with little or no additional electric power consumption, for example. Indeed, while some surface cooling may still be desired, the amount of cooling is greatly reduced with the double-wall structure 40.

Additionally, the may be cases where it is desirable that RF power be increased to make up for energy lost from the near-antenna pay zone. Even in this case, added input power to vaporize the solvent is significantly less than for a separate heater.

A method aspect is directed to a method for hydrocarbon resource recovery from at least one well 24 in a subterranean formation 21. The method includes supplying radio frequency (RF) power to a double-wall structure 40 within the at least one well 24 to define an RF antenna 30 to provide RF heating to the subterranean formation 21. The double-wall structure 40 may absorb heat from adjacent portions of the subterranean formation 21. The method may also include supplying solvent to a solvent passageway 44 defined between inner and outer walls 42, 43 of the double-wall structure 40. The outer wall 43 may have openings 49 therein to eject solvent into the subterranean formation. The double-wall structure 40 transfers heat to the solvent so that the ejected solvent is in a vapor state.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for hydrocarbon resource recovery from at least one well in a subterranean formation comprising:

a radio frequency (RF) source;

a solvent source;

a coolant source;

a double-wall structure coupled to said RF source to define an RF antenna within the at least one well to provide RF heating to the subterranean formation;

said double-wall structure comprising inner and outer walls defining a solvent passageway therebetween coupled to said solvent source, said outer wall having a plurality of openings therein to eject solvent into the subterranean formation, said double-wall structure transferring heat from adjacent material to the solvent so that at least a portion of the ejected solvent is in a vapor state; and an RF transmission line extending within said double-wall structure and coupling said RF source to said double-wall structure, said RF transmission line being coupled to said coolant source so that the coolant absorbs heat from said RF transmission line and transfers the heat to the solvent via the inner wall of said double-wall structure.

2. The apparatus according to claim 1 further comprising a choke coupled to said transmission line; and wherein said choke generates heat transferred to the solvent.

3. The apparatus according to claim 1 wherein said double-wall structure comprises a plurality of double-wall sections coupled together in end-to-end relation.

4. The apparatus according to claim 3 further comprising a coupler joining together respective ends of adjacent double-wall sections.

5. The apparatus according to claim 4 further comprising at least one jumper line coupling adjacent double-wall sections.

6. The apparatus according to claim 5 further comprising a clamp surrounding said coupler.

7. The apparatus according to claim 1 wherein the at least one wellbore comprises a horizontally extending injection wellbore and a horizontally extending production wellbore therebelow; and wherein said double-wall structure is to be positioned within the horizontally extending injection wellbore.

8. The apparatus according to claim 7 further comprising a producer structure to be positioned within the horizontally extending production wellbore.

9. The apparatus according to claim 1 wherein said solvent source comprises a source of at least one of butane and propane.

10. An apparatus for hydrocarbon resource recovery from at least one well in a subterranean formation comprising:

a double-wall structure to be coupled to a radio frequency (RF) source to define an RF antenna within the at least one well to provide RF heating to the subterranean formation;

said double-wall structure comprising inner and outer walls defining a solvent passageway therebetween coupled to said solvent source, said outer wall having a plurality of openings therein to eject solvent into the subterranean formation, said double-wall structure transferring heat from adjacent material to the solvent so that at least a portion of the ejected solvent is in a vapor state; and an RF transmission line extending within said double-wall structure and coupled to said double-wall structure, said RF transmission line to be coupled to a coolant source so that the coolant absorbs heat from said RF transmission line and transfers the heat to the solvent via the inner wall of said double-wall structure.

11. The apparatus according to claim 10 further comprising a choke coupled to said transmission line; and wherein said choke generates heat transferred to the solvent.

12. The apparatus according to claim 10 wherein said double-wall structure comprises a plurality of double-wall sections coupled together in end-to-end relation.

13. The apparatus according to claim 12 further comprising a coupler joining together respective ends of adjacent double-wall sections.

14. The apparatus according to claim 10 wherein the at least one wellbore comprises a horizontally extending injection wellbore and a horizontally extending production wellbore therebelow; and wherein said double-wall structure is to be positioned within the horizontally extending injection wellbore.

15. The apparatus according to claim 14 further comprising a producer structure to be positioned within the horizontally extending production wellbore.

16. A method for hydrocarbon resource recovery from at least one well in a subterranean formation comprising:

supplying radio frequency (RF) power to a double-wall structure within the at least one well to define an RF antenna to provide RF heating to the subterranean formation;

supplying solvent to a solvent passageway defined between inner and outer walls of the double-wall structure, the outer wall having a plurality of openings therein to eject solvent into the subterranean formation, the double-wall structure transferring heat from adjacent material to the solvent so that at least a portion of the ejected solvent is in a vapor state; and supplying coolant to an RF transmission line extending within the double-wall structure so that the coolant absorbs heat from the RF transmission line and transfers the heat to the solvent via the inner wall of the double-wall structure.

17. The method according to claim 16 wherein the at least one wellbore comprises a horizontally extending injection wellbore and a horizontally extending production wellbore therebelow; and wherein the double-wall structure is positioned within the horizontally extending injection wellbore.

18. The method according to claim 17 further comprising recovering hydrocarbons from a producer structure positioned within the horizontally extending production wellbore.

19. The method according to claim 16 wherein supplying solvent comprises supplying at least one of butane and propane.

20. The apparatus according to claim 1 wherein the adjacent material comprises adjacent portions of the subterranean formation.

21. The apparatus according to claim 10 wherein the adjacent material comprises adjacent portions of the subterranean formation.

22. The method according to claim 16 wherein the adjacent material comprises adjacent portions of the subterranean formation.

23. An apparatus for hydrocarbon resource recovery from at least one well in a subterranean formation comprising:

a radio frequency (RF) source;

a coolant source;

a solvent source;

a double-wall structure coupled to said RF source to define an RF antenna within the at least one well to provide RF heating to the subterranean formation;

said double-wall structure comprising inner and outer walls defining a solvent passageway therebetween coupled to said solvent source, said outer wall having a plurality of openings therein to eject at least a portion of the solvent in a vapor state into the subterranean formation; and an RF transmission line extending within said double-wall structure and coupling said RF source to said double-wall structure, said RF transmission line being coupled to said coolant source so that the coolant absorbs heat from said RF transmission line and transfers the heat to the solvent via said double-wall structure.

24. The apparatus according to claim 23 further comprising a choke coupled to said transmission line; and wherein said choke generates heat transferred to the solvent.

25. The apparatus according to claim 24 wherein said double-wall structure comprises a plurality of double-wall sections coupled together in end-to-end relation.

26. The apparatus according to claim 24 wherein the at least one wellbore comprises a horizontally extending injection wellbore and a horizontally extending production wellbore therebelow; and wherein said double-wall structure is to be positioned within the horizontally extending injection wellbore.

27. The apparatus according to claim 24 wherein said solvent source comprises a source of at least one of butane and propane.

* * * * *